US005988912A

United States Patent [19]

Chen

[11] Patent Number: 5,988,912

[45] Date of Patent: Nov. 23, 1999

[54] CLEANING EQUIPMENT

[76] Inventor: Chih-Jen Chen, P.O. Box 82-144, Taipei, Taiwan

[21] Appl. No.: 09/113,973

[22] Filed: Jul. 13, 1998

[51] Int. Cl.[6] ..... A46B 11/06

[52] U.S. Cl. ..... 401/42; 401/43; 401/137; 401/139; 401/290

[58] Field of Search ..... 401/42, 43, 137, 401/139, 290

[56] References Cited

U.S. PATENT DOCUMENTS 371,515 10/1887 Nowotny ..... 401/137
630,600 8/1899 Durant ..... 401/43
854,151 5/1907 Deasy ..... 401/137 X
1,777,152 9/1930 Poteet ..... 401/43 X

*Primary Examiner*—Steven A. Bratlie
*Attorney, Agent, or Firm*—A & J

[57] ABSTRACT

A cleaning equipment includes a brush head having a body portion formed with a dovetail groove at an opposite side thereof and a plurality of holes close to one side of the dovetail groove, an adapter having a tubular member formed with an axial outlet which is connected with a sectorial member, and a tubular handle provided with a valve assembly and a container engaged with the valve assembly, whereby the cleaning equipment can automatically dispense a mixture of water and liquid detergent as desired.

2 Claims, 13 Drawing Sheets

CLEANING EQUIPMENT

BACKGROUND OF THE INVENTION

1. Field of the Invention

This invention is related to a cleaning equipment and in particular to one which can dispense liquid detergent for cleaning things as desired.

2. Description of the Prior Art

The conventional cleaning brush includes a hollow handle having a rear open end closed by a cap and a front end fixedly mounted with a coupling, and a brush head coupled to the flange of the coupling and secured in place by a locking lock. However, when cleaning household things with such a conventional cleaning brush, a detergent must be separately applied, thereby causing much inconvenience in use.

Therefore, it is an object of the present invention to provide a cleaning equipment which can obviate and mitigate the above-mentioned drawbacks.

SUMMARY OF THE INVENTION

This invention is related to an improved cleaning equipment.

It is the primary object of the present invention to provide a cleaning equipment which can automatically dispense a mixture of water and liquid detergent for cleaning things as desired.

It is another object of the present invention to provide a cleaning equipment which can automatically dispense water for cleaning things as desired.

It is still another object of the present invention to provide a cleaning equipment having an adapter which can adjust the water dispensing position.

It is another object of the present invention to provide a cleaning equipment which is easy to operate and facile to manufacture.

It is a further object of the present invention to provide a cleaning equipment which is simple in construction and fit for practical use.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
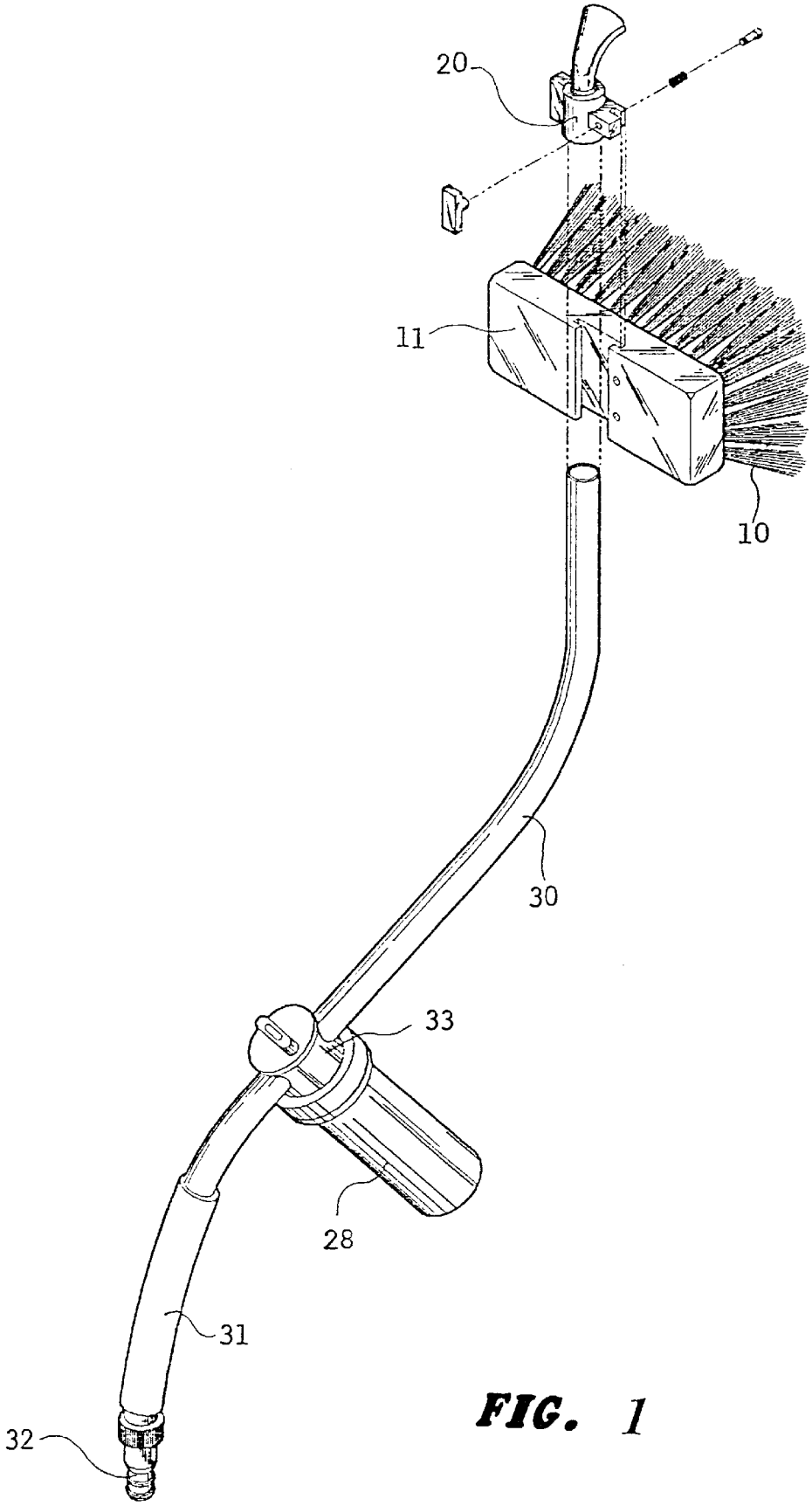
FIG. 1 is a perspective view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Referring first to FIG. 1, the cleaning equipment according to the present invention generally comprises a brush head 10, an adapter 20 and a handle 30.

Figure 2:
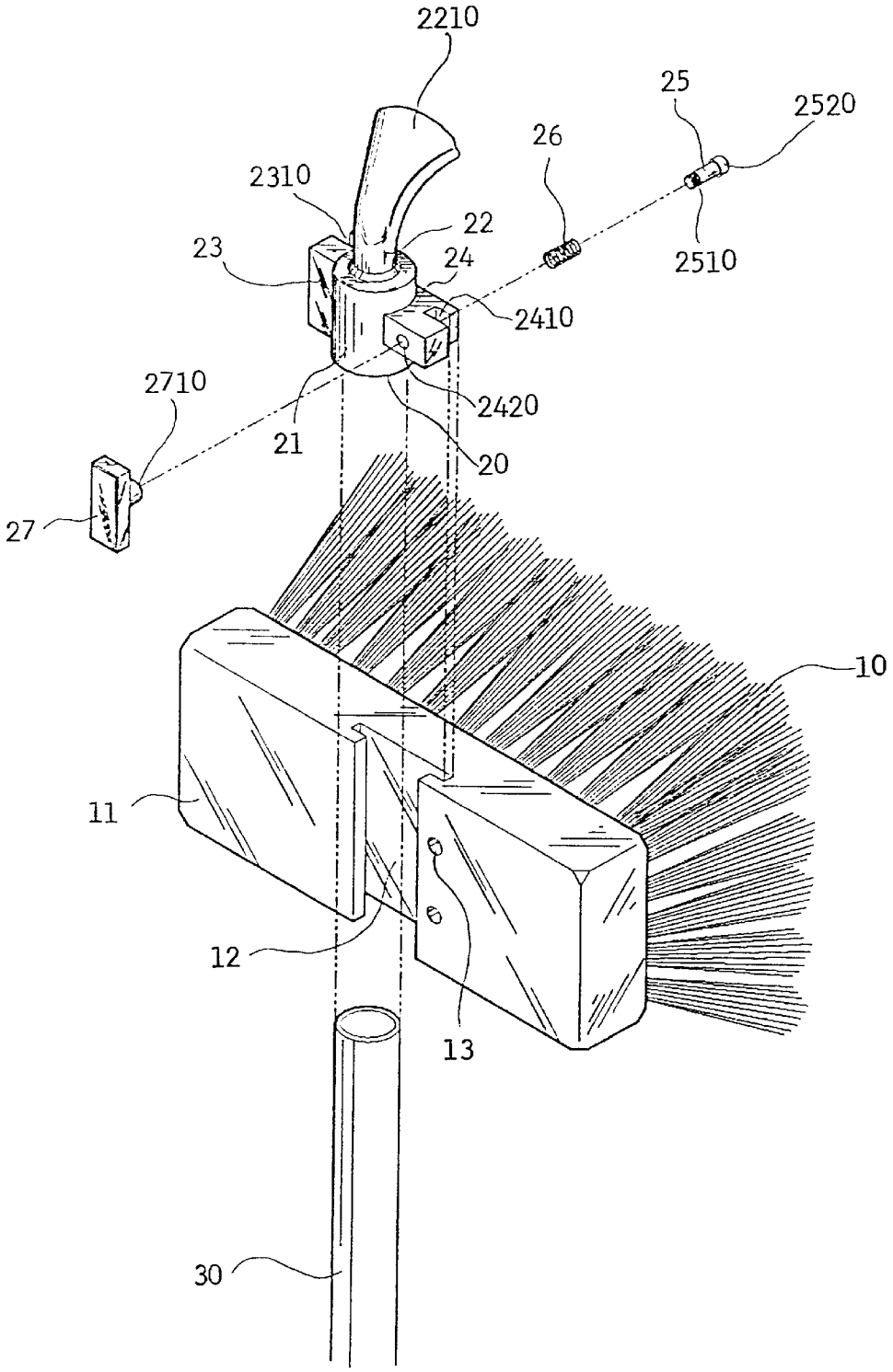
FIG. 2 is an enlarged exploded view of the upper portion of the present invention.
Figure 3:
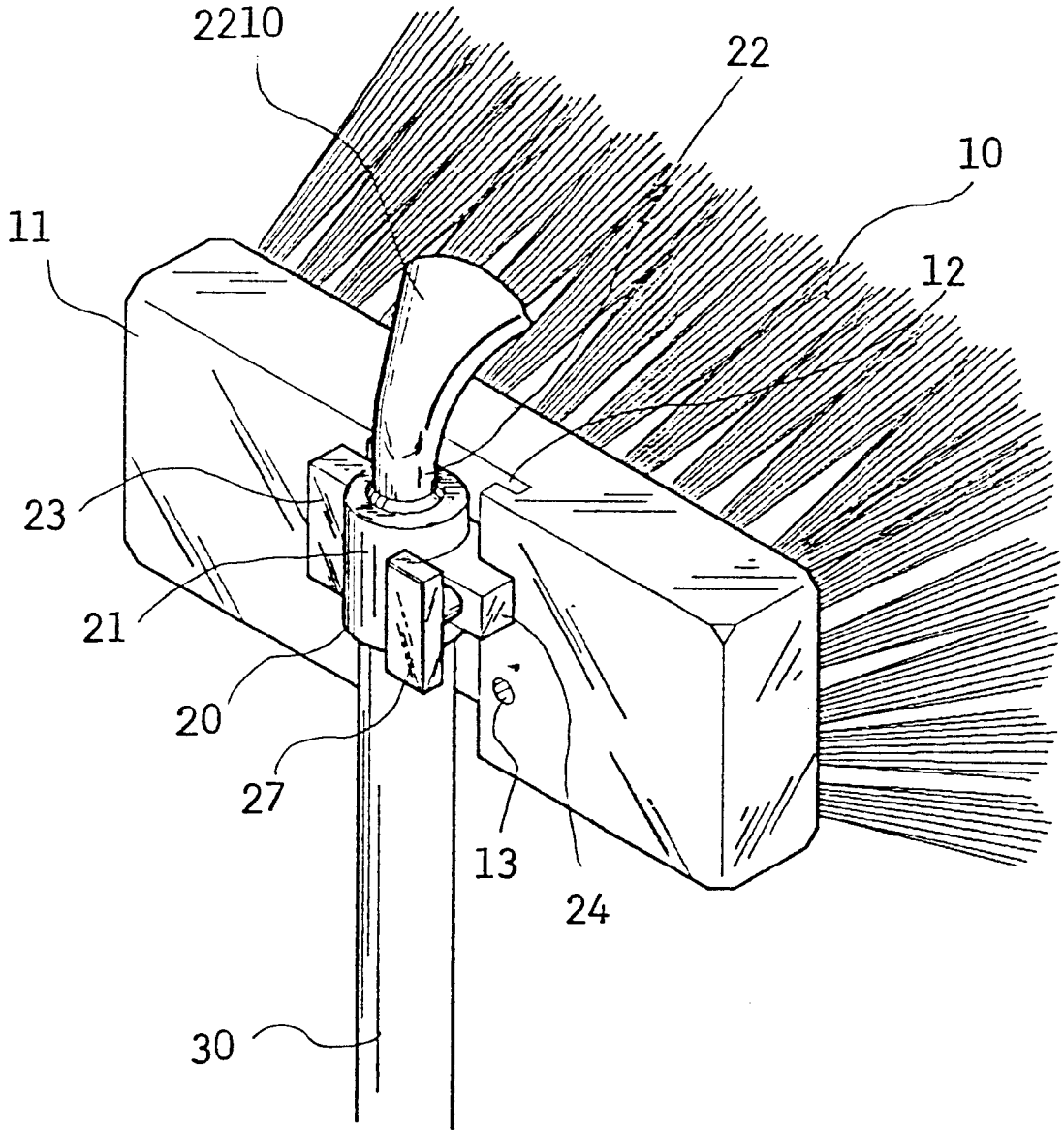
FIG. 3 is an enlarged perspective view of the upper portion of the present invention.
Figure 4A:
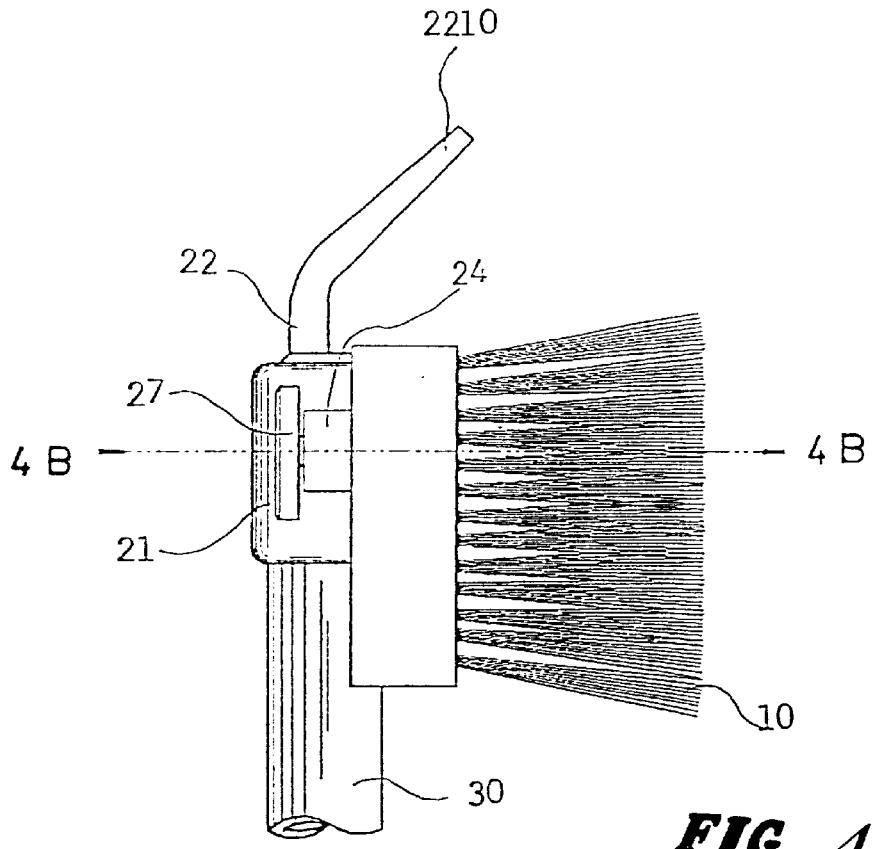
FIG. 4A is a side view of the brush head.
Figure 4B:
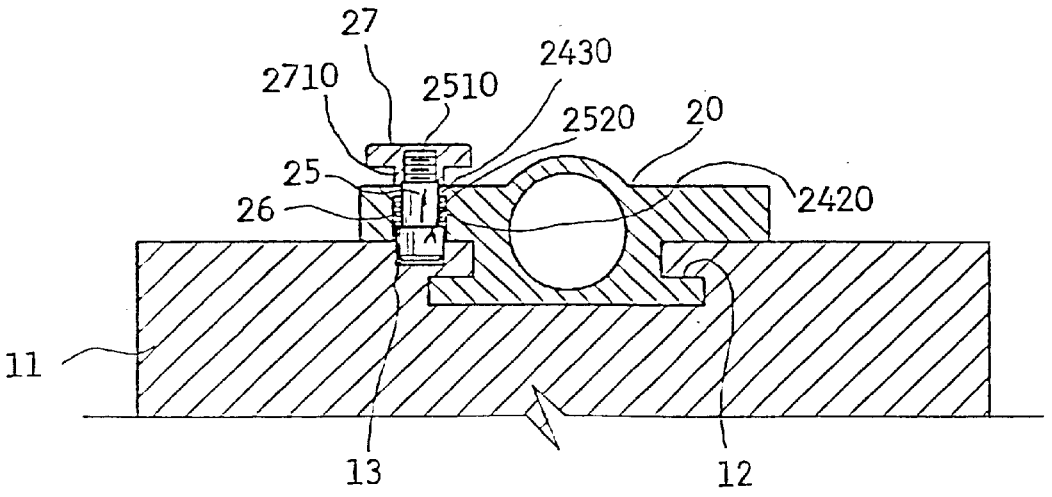
FIG. 4B is a sectional view taken along line 4B—4B of FIG. 4A.
Figure 5:
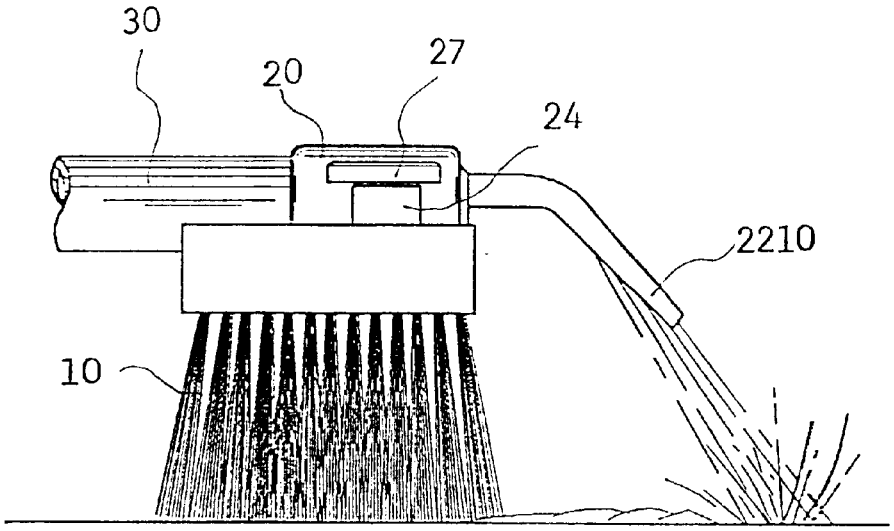
FIGS. 5 and 6 illustrate how to adjust the position of the adapter.
Figure 6:
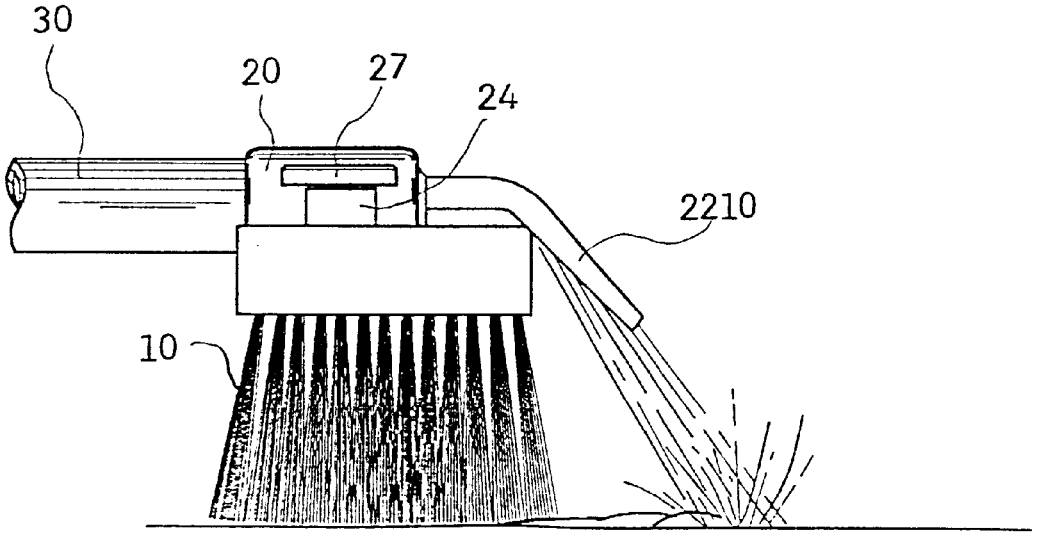

As shown in FIGS. 2 and 3, the brush head 10 includes a body portion 11 provided with bristles at one side thereof and formed with a dovetail groove 12 at an opposite side thereof and a plurality of holes 13 close to one side of the dovetail groove 12.

Turning to FIGS. 1, 2, 4A and 4B, the adapter 20 includes a tubular member 21 formed with an axial outlet 22 which is connected with a guiding member 2210. The tubular member 21 has two shoulders 23 and 24 at two opposite sides thereof which are formed with flanges 2310 and 2410. The adapter 20 is connected with the brush head 10, with the flanges 2310 and 2410 fitted in the grooves 12 of the body portion 11. A bolt 25 with external threads 2510 enclosed with a spring 26 extends through a hole 2420 of the shoulder 24 to engage with a tubular portion 2710 of a rectangular button 27, so that the button 27 will be pulled downward with respect to FIG. 4B.

Referring to FIGS. 2, 4, 5 and 6, the adapter 20 can be moved on the body portion 11 by means of the sliding engagement between the flanges 2310 and 2410 and the groove 12. In addition, the adapter 20 can be kept at a fixed position on the body portion 11 by the engagemenet between the bolt 25 and the hole 13. When desired to adjust the position of the adapter 20, it is only necessary to pull the button 27 out of the hole 13, move the adapter 20 to another position and then engage the button 27 with another hole 13.

The handle 30 is an elongated tubular member provided with a grip 31 close to a lower end thereof and a connector 32 at the lower end. Furthermore, the handle 30 may be composed of two or more sections so as to make it easier to be stowed. The upper end of the handle 30 is connected with the adapter 20 so that water or liquid cleaning agent may flow out of the outlet 22 of the adapter 20 for cleaning purpose. The guiding member 2210 is used for guiding the flow direction of water or liquid cleaning agent.

Figure 7:
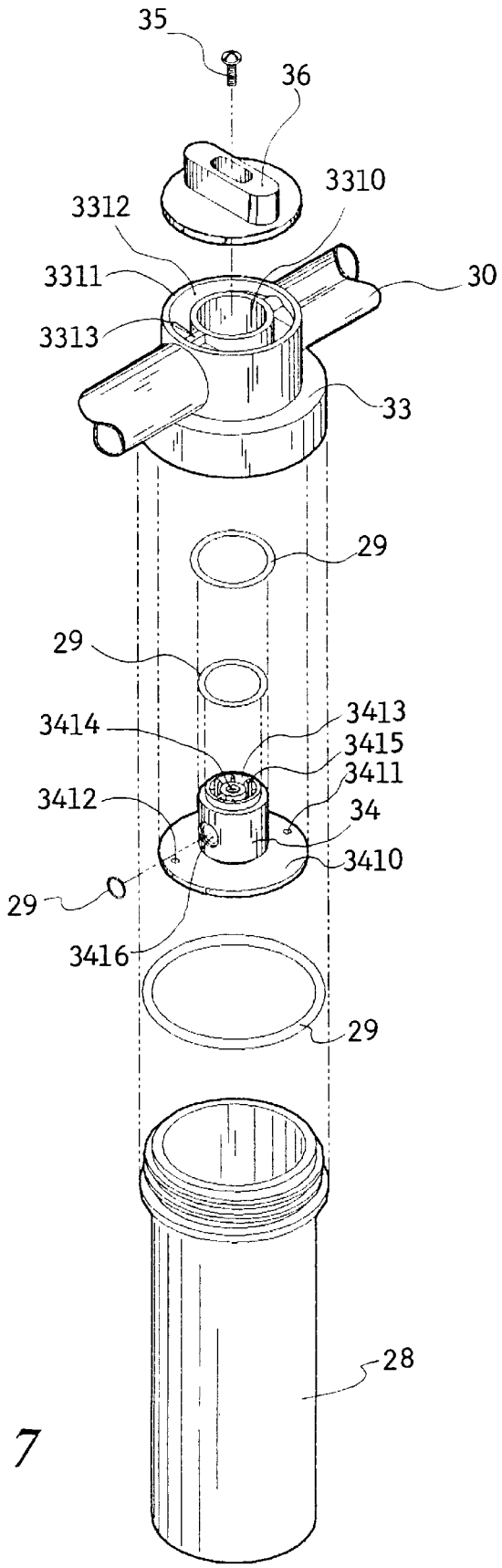
FIG. 7 is an exploded view of the valve assembly.
Figure 8:
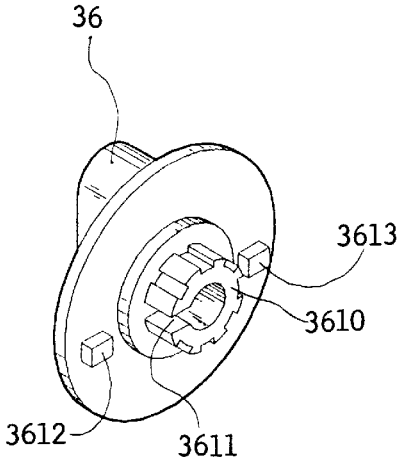
FIG. 8 is a perspective view of the knob.
Figure 9:
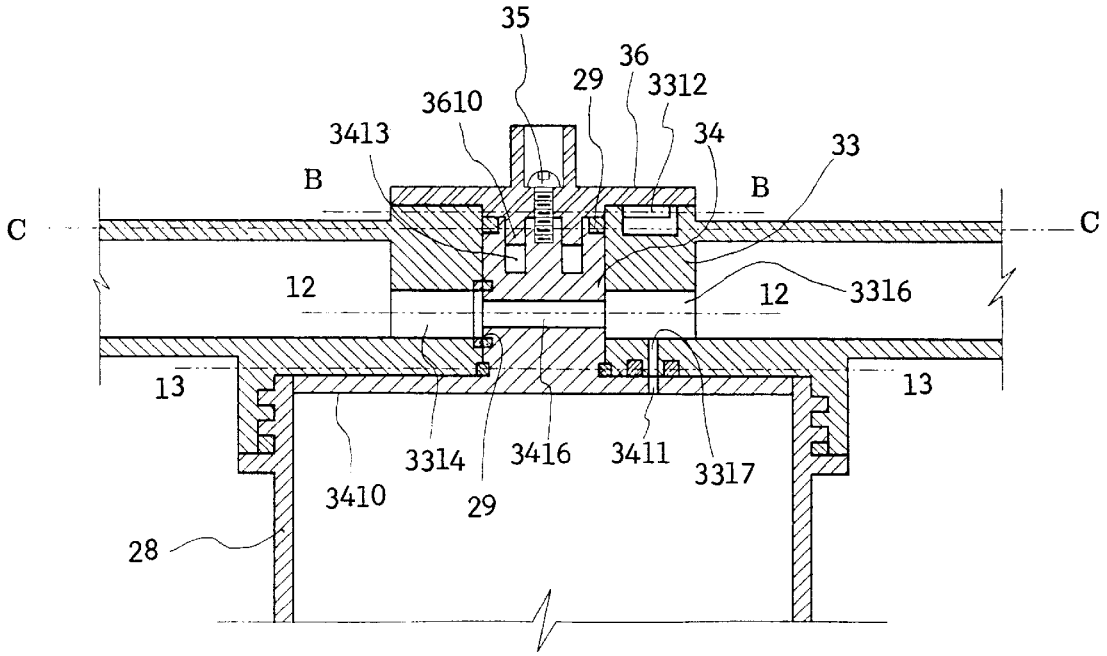
FIG. 9 is a sectional view of the valve assembly in open condition.
Figure 10:
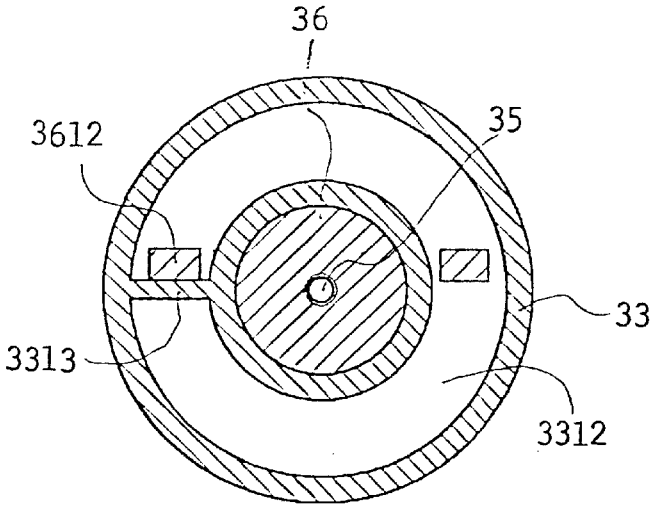
FIG. 10 is a sectional view taken along line 10—10 of FIG. 9.
Figure 11:
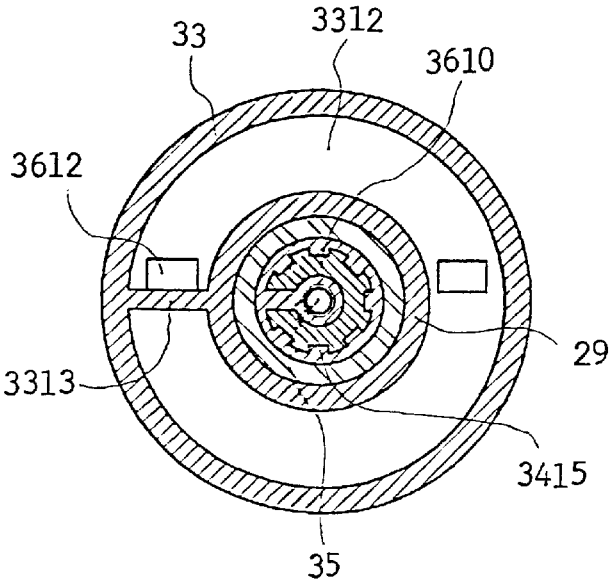
FIG. 11 is a sectional view taken along line 11—11 of FIG. 9.

As shown in FIGS. 1 and 7, the handle 30 is provided with a valve seat 33 close to the grip 31. A container 28 is engaged with the valve seat 33. A seal 29 is fitted between the container 28 and the valve seat 33. The valve seat 33 has an inner tubular portion 3310 and an outer tubular portion 3311 thus forming an annular recess 3312 therebetween. A partition 3313 is arranged within the annular recess 3312. A cylindrical valve body 34 is fitted in the inner tubular portion 3310, which is provided with a circular base 3410 having two holes 3411 and 3412. The valve body 34 has a cylindrical recess 3413 provided at the center with a circular portion having a threaded hole 3414 and connected with the wall of the cylindrical recess 3413 by a plurality of radial ribs 3415. A hole 3416 extends radially through the valve body 34. A seal 29 is fitted within the hole 3416. A knob 36 is mounted on the valve body 34 by a screw 35 extending through the knob 36 to engage with the threaded hole 3414 of the valve body 34. As shown in FIG. 8, the bottom of the knob 36 has a tubular portion 3610 formed with a plurality of longitudinal threads and a notch 3611. The knob 36 has a circular base formed with two opposite projections 3612 and 3613. As illustrated in FIGS. 9, 10 and 11, the projection 3612 of the knob 36 is just in contact with the partition 3313, while the tubular portion of the knob 36 is fitted in the cylindrical recess 3413 of the valve body 34, so that the valve body 34 can be rotated by turning the knob 36.

Figure 12:
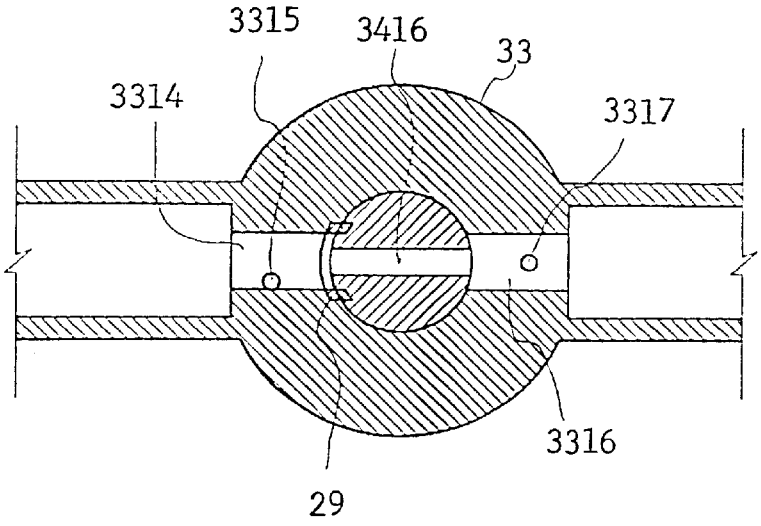
FIG. 12 is a sectional view taken along line 12—12 of FIG. 9.
Figure 13:
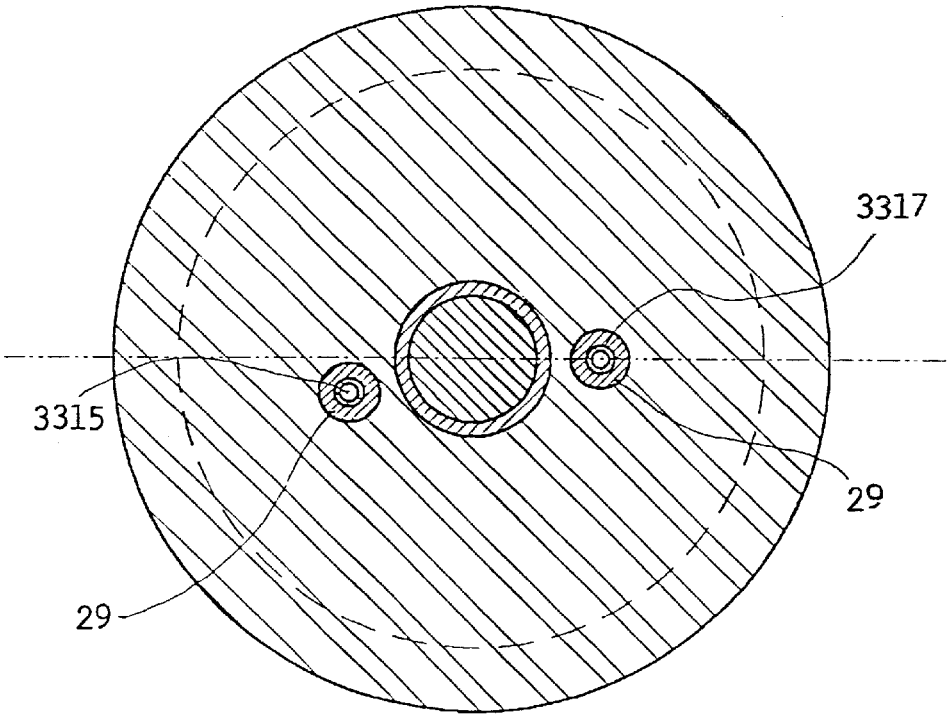
FIG. 13 is a sectional view taken along line 13—13 of FIG. 9.

As shown in FIGS. 9, 12 and 13, the valve seat 33 has an axial inlet 3314, a vertical water inlet hole 3315 communicated with the axial inlet 3314 and located at an eccentric position with respect to the axis of the axial inlet 3314, an axial outlet 3316 having the same axis of the axial inlet 3314, and a vertical water outlet hole 3317 communicated with the axial inlet 3314 and having an axis intersecting the axis of the axial outlet 3316. The bottom of each of the water inlet and outlet holes 3315 and 3317 is provided with a seal ring 29. The valve seat 33 is mounted on the valve body 34 so that the holes 3411 and 3412 are aligned with the inlet and outlet holes 3315 and 3317. When the hole 3416 of the valve body 34 is aligned with the axial inlet and outlet holes 3314 and 3316, water will flow through the water inlet 3314, the hole 3416 and the water outlet 3316 from the water inlet hole 3315. Meanwhile, some water flows out of the water outlet hole 3317 and into the container 28 to mix with the liquid detergent and then the mixture of water and liquid detergent will flow out of the hole 3317 to mix with the water flowing through the hole 3316. Finally, the water will be discharged out of the outlet 22 of the adapter 20.

Figure 14:
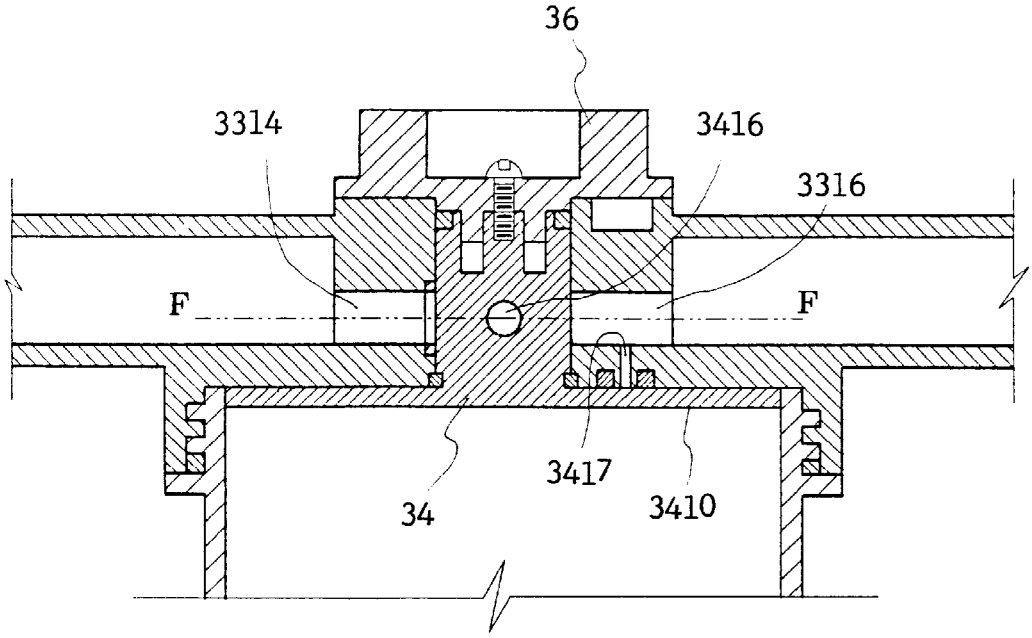
FIG. 14 is a sectional view of the valve assembly in closed position.
Figure 15:
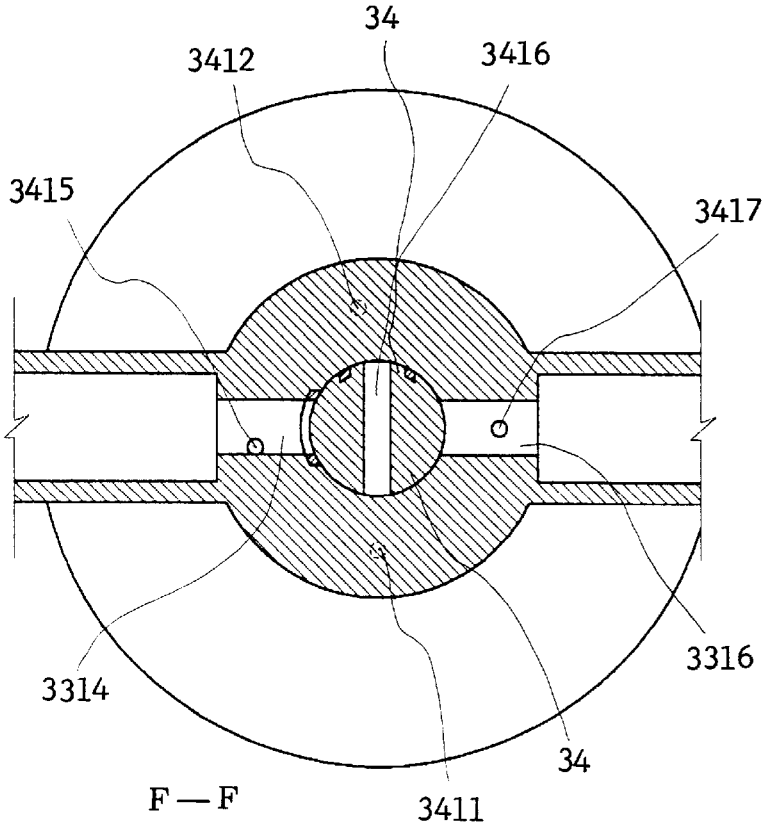
FIG. 15 is a sectional view taken along line 15—15 of FIG. 14.

Referring to FIGS. 14 and 15, when the knob 36 is turned so that the hole 3416 of the valve body 34 is not aligned with the axial inlet and outlet holes 3314 and 3316 of the valve body 34, the holes 3411 and 3412 of the valve body 34 will not be aligned with the water inlet and outlet holes 3315 and 3317 too thereby preventing water from flowing therethrough and the liquid detergent from flowing out of the container 28.

Figure 16:
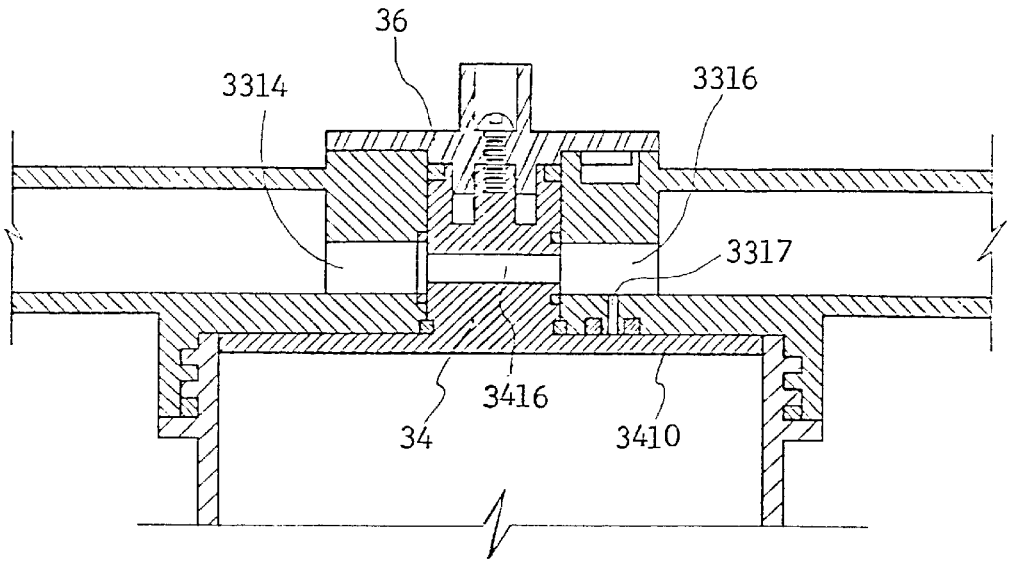
FIGS. 16 and 17 are sectional views illustrating another open condition of the valve assembly.
Figure 17:
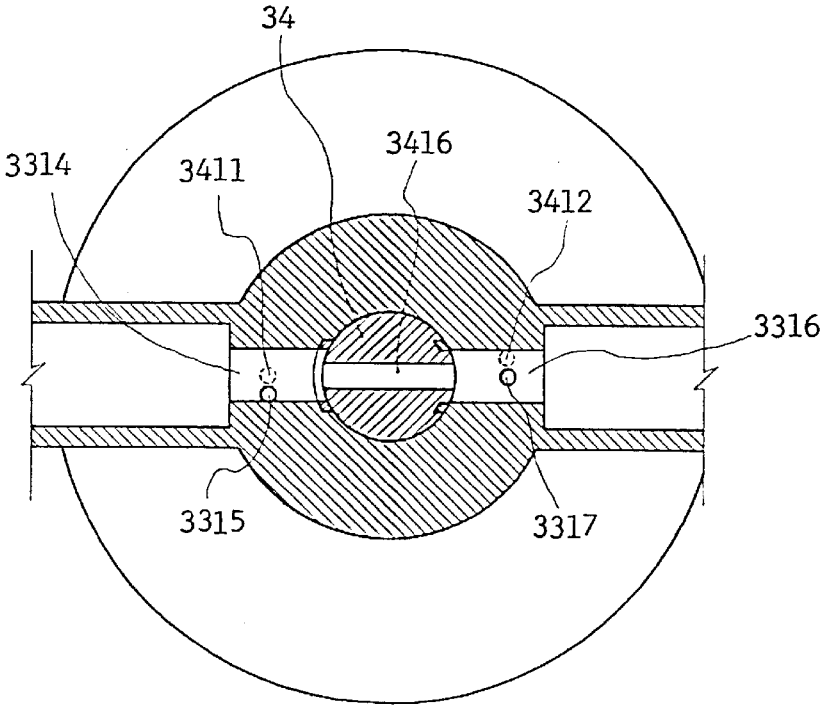
Figure 18:
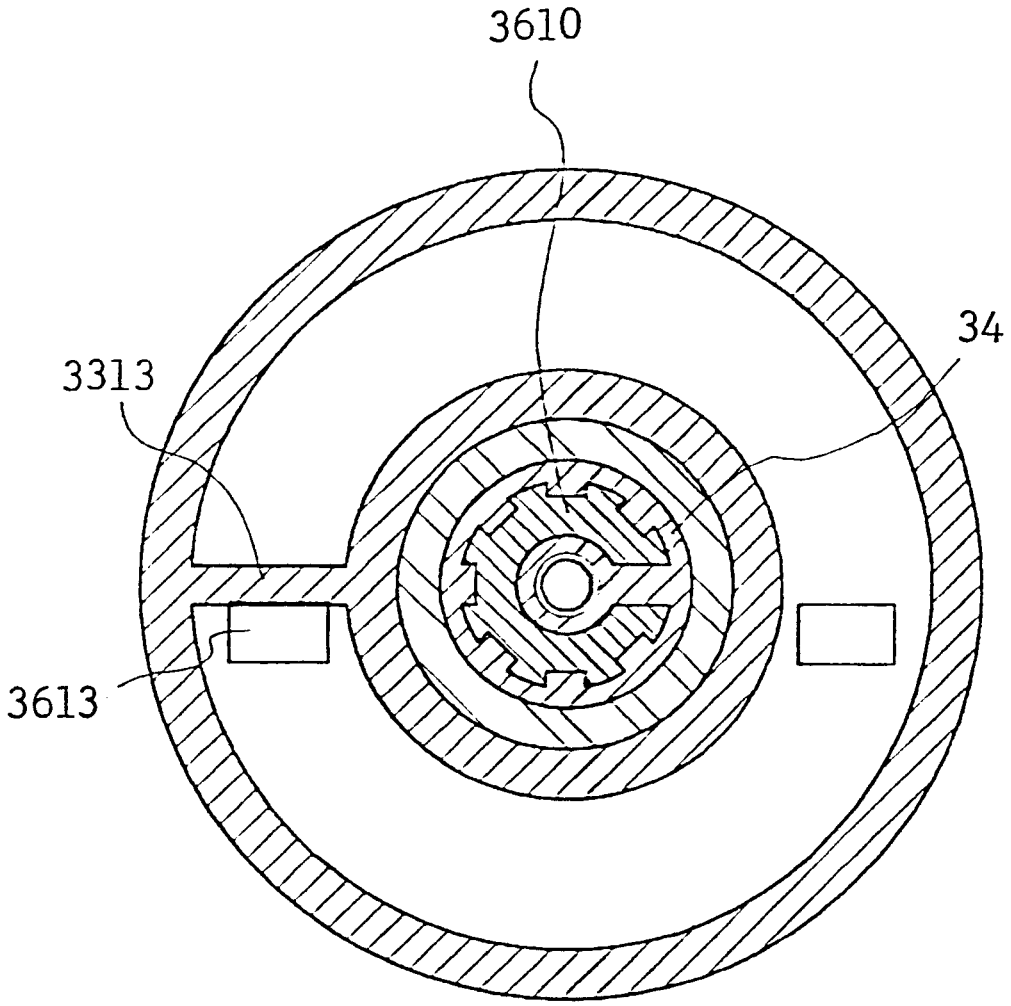
FIG. 18 illustrates how the knob is positioned.

Referring to FIGS. 16 and 17, when the knob 36 is turned clockwise so that the hole 3416 of the valve body 34 is aligned with the axial inlet and outlet holes 3314 and 3316 but the holes 3411 and 3412 are not aligned with the water inlet and outlet holes 3315 and 3317, only water can flow through valve body 34 and no water is permitted to enter into the container 28 thereby providing only water for the brush. As shown in FIG. 18, when the rib 331 is in contact with the projection 3613, the tubular portion 3610 of the valve body 34 is kept a fixed position.

Figure 19:
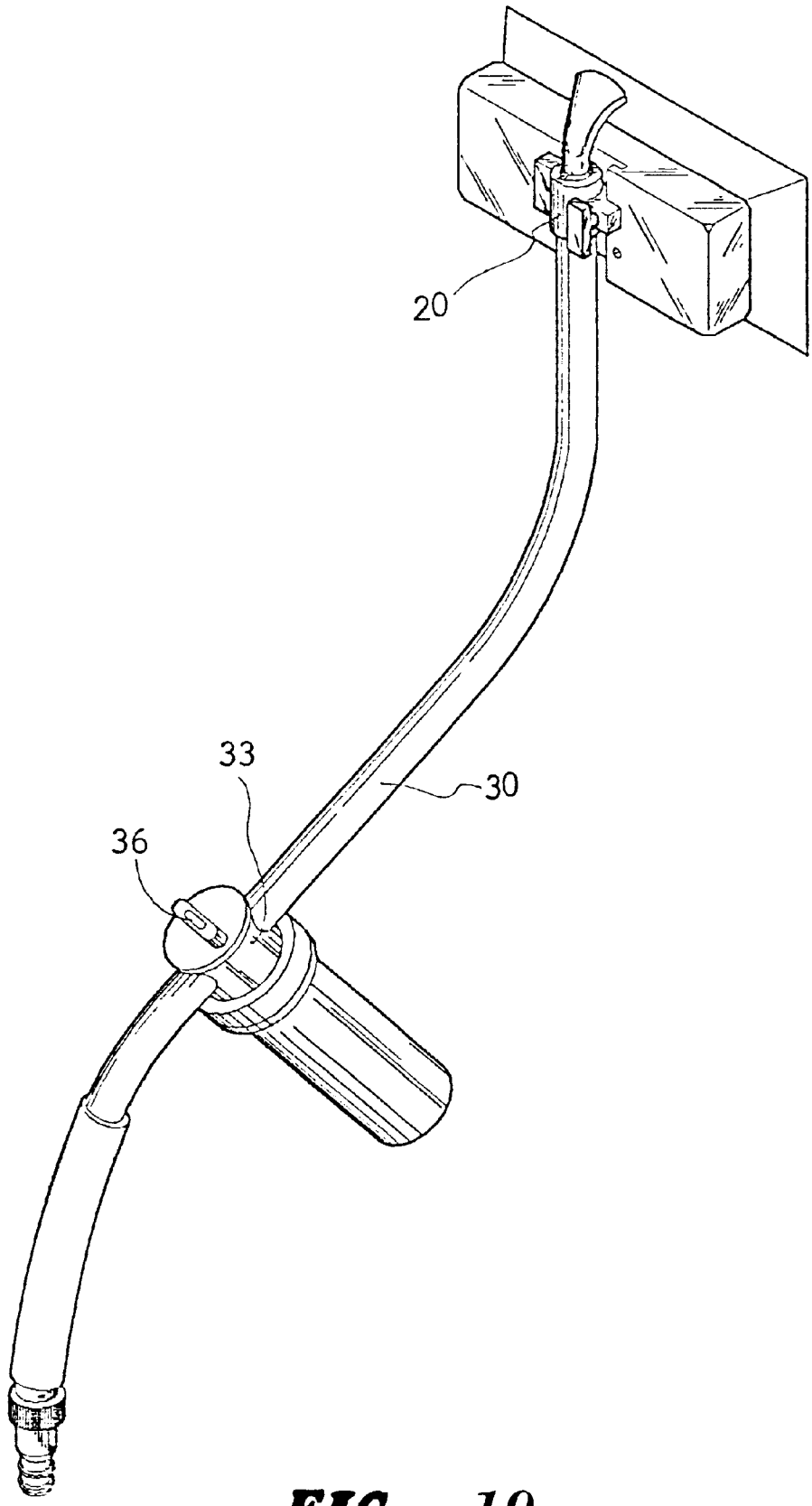
FIG. 19 shows another preferred embodiment of the present invention.

Referring to FIG. 19, the brush with bristles may be replaced with one with a sponge.

The invention is naturally not limited in any sense to the particular features specified in the foregoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A cleaning equipment comprising:

a brush head including a body portion formed with a dovetail groove at an opposite side thereof and a plurality of holes close to one side of said dovetail groove;

an adapter including a tubular member formed with an axial outlet which is connected with a sectorial member, said tubular member having two shoulders at two opposite sides thereof each having a flange, said adapter being connected with said brush head with said flanges fitted in said groove, and a bolt enclosed with a spring extending through a hole of one of said shoulders to engage with a tubular portion of a button; and a tubular handle provided with a valve assembly and a container engaged with said valve assembly, said valve assembly including a valve seat, a valve body and a knob, said valve seat having an inner tubular portion and an outer tubular portion thus forming an annular recess therebetween, a partition arranged between said inner and outer tubular portions, said valve body being fitted in said inner tubular portion and having a cylindrical recess having a threaded hole and a plurality of radial ribs, a hole extending radially therethrough, said knob being mounted on said valve body by a screw extending through said knob to engage with said threaded hole, said valve seat having an axial inlet and an axial outlet.

2. The cleaning equipment as claimed in claim 1, wherein said valve seat has a vertical water inlet hole communicated with said axial inlet and located at an eccentric position with respect to an axis of said axial inlet, and a vertical water outlet hole communicated with said axial inlet and having an axis intersecting an axis of said axial outlet, and said valve body is provided with a circular base having two holes in communication with said container.

* * * * *